US005358240A

United States Patent [19]

Lawlor et al.

[11] Patent Number: 5,358,240

[45] Date of Patent: Oct. 25, 1994

[54] BALL DIVERTER FOR RAISED RAMP

[75] Inventors: Patrick Lawlor, Marengo; John Krutsch, Glenview, both of Ill.

[73] Assignee: Williams Electronics Games, Inc., Chicago, Ill.

[21] Appl. No.: 58,560

[22] Filed: May 6, 1993

[51] Int. Cl.[5] ..... A63F 7/30

[52] U.S. Cl. ..... 273/118 R; 273/118 A; 273/119 A; 273/121 A; 273/127 R; 273/127 D

[58] Field of Search ..... 273/118–125, 273/127 R

[56] References Cited

U.S. PATENT DOCUMENTS 4,981,298 1/1991 Lawlor et al. ..... 273/121 A
5,120,059 6/1992 Oursler ..... 273/121 A

*Primary Examiner*—William E. Stoll
*Assistant Examiner*—Raleigh W. Chiu
*Attorney, Agent, or Firm*—Rockey, Rifkin and Ryther

[57] ABSTRACT

The ball diverter of the invention consists of a pivoting cage located above an elevated track. The cage, when in its lowered position, will intercept a ball rolling on the track. The cage can then be pivoted to remove the ball from the track and deposit it on a surface disposed beneath the track. When the cage is in the raised position, the ball is allowed to traverse the track uninterrupted.

8 Claims, 1 Drawing Sheet

BALL DIVERTER FOR RAISED RAMP

BACKGROUND OF THE INVENTION

The invention relates, generally, to pinball games and, more particularly, to an improved ball diverter for such games.

Pinball games typically include an inclined playfield supporting a rolling ball and a plurality of play features such as targets, ramps, bumpers and the like. The player manipulates flippers mounted on the playfield to direct the ball at selected play features thereby controlling play of the game.

Most pinball games include ramps, tracks, lanes or similar structures that define confined paths of travel for the ball. It is known in the art to provide ball diverter gates and other obstructions in these paths to control the movement of the ball on the playfield and to control access to other play features. One such ball diverter gate is shown in U.S. Pat. No. 4,981,298 to Lawlor et al. where abutting surfaces separate to create a ball channel. Another ball diverter is shown in U.S. Pat. No. 4,822,046 to Kim et al. which shows a rotating member having grooves that define alternate ball paths. Other ball diverters consist simply of movable gates that direct the ball in predetermined directions.

While such devices have been successful, it is necessary for game manufacturers to constantly create new and improved play features to attract players to their games. Thus, a new ball diverter gate is desired. Moreover, a ball diverter that can remove a ball from an elevated ramp and place it on a lower surface is desired.

SUMMARY OF THE INVENTION

The ball diverter of the invention consists of a pivoting cage located above an elevated track. The cage, when in its lowered position, will intercept a ball rolling on the track. The cage can then be pivoted to remove the ball from the track and deposit it on a surface disposed beneath the track. When the cage is in the raised position, the ball is allowed to traverse the track uninterrupted.

DETAILED DESCRIPTION OF THE INVENTION

Figure 1:
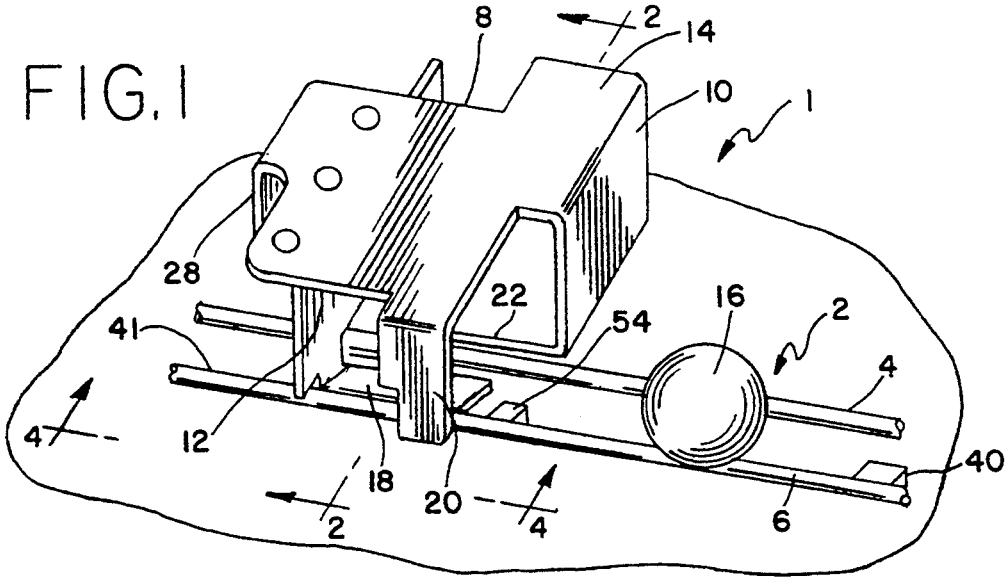
FIG. 1 is a perspective view of the ball diverter of the invention.
Figure 4:
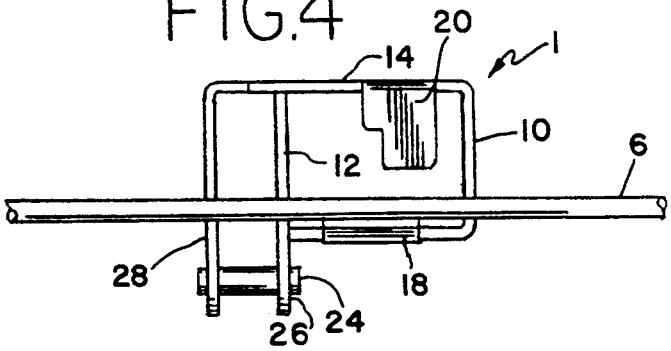
FIG. 4 is a view taken along line 4—4 of FIG. 1.

Referring more particularly to the Figures, the ball diverter of the invention is shown generally at 1 mounted adjacent the path of travel of a ball such as track 2, defined by rails 4 and 6. The ball diverter 1 includes a cage 8 having side walls 10 and 12 and a top wall 14. Sidewall 10 terminates adjacent track 2 to allow ball 16 to pass the sidewall and enter cage 8 when the cage is in the lowered position of FIGS. 1, 2 and 4. Conversely, sidewall 12 extends into the path of travel of the ball defined by track 2 such that when the cage is in the lowered position the ball will strike sidewall 12 and be stopped on track 2.

Figure 2:
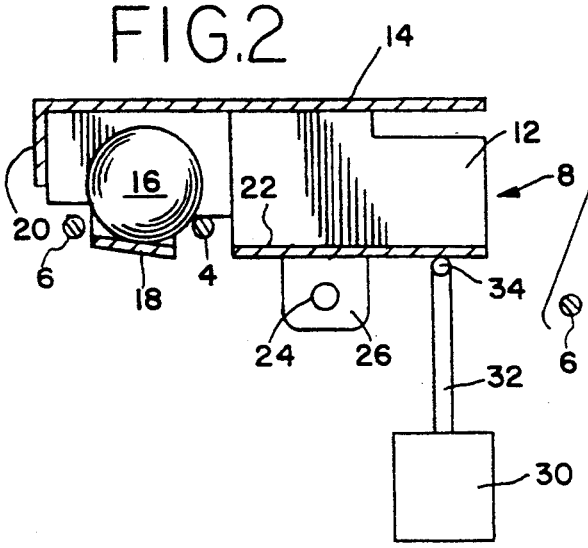
FIG. 2 is taken along line 2—2 of FIG. 1 showing the ball diverter of the invention in the lowered position.
Figure 3:
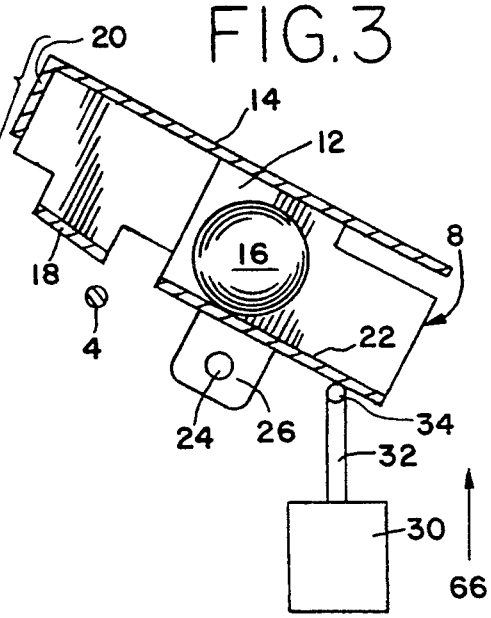
FIG. 3 is similar to that of FIG. 2 showing the ball diverter of the invention in the raised position.

A lift arm 18 extends from side wall 12 and is configured so as to extend beneath the ball when the ball is stopped on track 2 in cage 8. Lift arm 18 is disposed at an angle relative to horizontal, as best shown in FIGS. 2 and 3, such that as the cage is raised from the position of FIG. 2 to the position of FIG. 3, arm 18 will propel the ball into cage 8. A stop member 20 extends down from top wall 14 and is located at the outside of track 2 to prevent the ball from inadvertently leaving track 2 as the cage 8 is pivoted. To the side of track 2 opposite stop member 20, the side walls 10 and 12, top wall 16 and the bottom wall 22 define a chute for allowing the ball to exit cage 8.

The ball diverter 1 is supported on pivot pin 24 that is fixed to the track 2 or any other suitable structure of the game. Pin 24 rotatably supports a first flange 26 extending from sidewall 12 and a second flange 28 that extends from top wall 14. A solenoid 30 is mounted below playfield 5 with its plunger 32 connected to cage 8 pivot 34. When the solenoid is activated, plunger 32 is retracted thereby causing cage 8 to pivot about pin 24 to the raised position of FIG. 3. The cage is returned to the lowered position of FIG. 2 by a compression spring (not shown) when solenoid 30 is deactivated.

To control the activation of solenoid 30, a ball sensor 40, such as an optical switch, is located on track 2 upstream of diverter 1. When a ball traversing track 2 trips switch 40, a signal is delivered to the game microprocessor informing it that a ball is traveling toward diverter 1. Upon receipt of this information, the microprocessor can control solenoid 30 to enable diverter 1 to perform various functions depending on the game program as will hereinafter be described.

For example, upon receipt of the signal the microprocessor could activate solenoid 30 to pivot cage 8 to its raised position to allow the ball to traverse track 2 uninterrupted. Once the ball has passed cage 8, the solenoid can be deactivated and the cage lowered to its original position. The deactivation of solenoid 30 can be based on a signal from a sensor 41 located downstream of diverter 1 or it can be based on the lapse of a preset time.

Alternatively, upon receipt of the signal from sensor 40, the cage can remain in its lowered position thereby to intercept the ball and prevent it from traversing track 2. The raising or lowering of cage 8 is, in a preferred embodiment, based on the game player achieving a predetermined game objective. For example, the player may be required to complete a predetermined sequence of shots before the ball is allowed to traverse track.

A second sensor 54 can be provided at the entrance to cage 8 to inform the game microprocessor that a ball has entered the cage. Upon receipt of a signal from sensor 54, the microprocessor can immediately activate the solenoid to raise the cage 8 and remove the ball from track 2. Specifically, the ball will be removed from track 2 by lift arm 18 and will travel through the chute defined by walls 10, 12, 16 and 22 as the cage is pivoted from its lowered position of FIG. 2 to the raised position of FIG. 3. A play feature such as track 66 can be located beneath the cage 8 such that ball is deposited on the track. It will be understood that the track 2 can be replaced by another play feature or the ball can be deposited directly on the playfield.

In yet another mode of operation, the cage 8 is not immediately pivoted when a ball enters the cage and triggers sensor 54. Rather, the ball is retained in cage 8 to be released at a future time to provide multiple ball play. Specifically, when the microprocessor determines that first a ball has entered cage 8, a second ball is given to the player to continue game play. The first ball is released back onto the play field by diverter 1 only after the player has completed a predetermined game objective as determined by the game microprocessor.

Thus, the play feature of the invention operates as a diverter to alter the path of travel of the ball, operates as a lift device to move the ball from a first elevation to a second lower elevation and operates to retain a ball to provide multiple ball play. It will be appreciated that numerous changes in the details of the construction and operation of the invention can be made without departing from the spirit and scope of the invention as set forth in the claims.

What is claimed is:

1. A pinball game having an inclined playfield supporting a rolling ball and a plurality of play features, one of the play features comprising:

a) first means for defining a path of travel for said ball, said first means being elevated relative to the playfield;

b) ball detector means for detecting a ball traveling on said first means;

c) diverter means movable between a first position in which travel of said ball over said first means is interrupted and the ball is retained, and a second position in which travel of said ball over said first means is uninterrupted;

d) means for moving said diverter means in response to the detection of a ball by the ball detector means between said first and second positions to selectively interrupt travel of the ball; and e) means for removing a retained ball from said path of travel and for depositing it at a location below said path of travel, said means for removing depositing the ball at the location as said diverter means is moved between the first position and the second position.

2. The pinball game according to claim 1, wherein said diverter means is a cage mounted for pivoting motion adjacent said path of travel.

3. The pinball game according to claim 2, wherein said cage includes a chute for directing the ball to said location.

4. The pinball game according to claim 2, wherein said means for pivoting said cage is a solenoid.

5. The pinball game according to claim 2, wherein said cage includes means for stopping and retaining the ball on the path of travel and means for lifting the ball from the path of travel.

6. The play feature according to claim 1, wherein said location includes another play feature.

7. The play feature according to claim 1, wherein said location is on said playfield.

8. A play feature for a pinball game, comprising:

a) first means for supporting the ball;

b) second means for defining a path of travel for a ball, said second means being elevated relative to the first means;

c) ball detector means for detecting a ball traveling on said second means;

d) diverter means movable between a first position in which travel of the ball over the second means is interrupted and the ball is retained, and a second position in which travel of the ball over the second means is uninterrupted;

e) means for moving said diverter between said first and second positions to selectively interrupt travel of the ball in response to the detection of a ball by the ball detector means; and f) means for removing a retained ball from the path of travel and for depositing it on said first means, said means for removing depositing the ball on said second means as the diverter means is moved between the first and second positions.

* * * * *

UNITED STATES PATENT AND TRADEMARK OFFICE

CERTIFICATE OF CORRECTION

PATENT NO. : 5,358,240
DATED : October 25, 1994
INVENTOR(S) : Lawlor, et. al.

It is certified that error appears in the above-indentified patent and that said Letters Patent is hereby corrected as shown below:

Column 4, claim 6, line 1, delete "play feature" and insert therefor--pinball game--.

Column 4, claim 7, line 1, delete "play feature" and insert therefor--pinball game--.

Signed and Sealed this

Twenty-eight Day of March, 1995

*Attest:*

Bruce Lehman

BRUCE LEHMAN

*Attesting Officer*

*Commissioner of Patents and Trademarks*